US005265679A

United States Patent [19]

Coronado et al.

[11] Patent Number: 5,265,679

[45] Date of Patent: Nov. 30, 1993

[54] EQUALIZING APPARATUS FOR USE WITH WIRELINE-CONVEYABLE PUMPS

[75] Inventors: Martin P. Coronado; Luis E. Mendez, both of Houston, Tex.

[73] Assignee: Baker Hughes Incorporated, Houston, Tex.

[21] Appl. No.: 851,099

[22] Filed: Mar. 13, 1992

[51] Int. Cl.[5] ..... E21B 34/10; E21B 34/14

[52] U.S. Cl. ..... 166/324; 166/332

[58] Field of Search ..... 166/53, 77, 250, 264, 166/324, 325

[56] References Cited

U.S. PATENT DOCUMENTS

| | | | |
|---|---|---|---|
| 3,856,085 | 12/1974 | Holden et al. | 166/264 |
| 3,887,158 | 6/1975 | Polk | 166/53 X |
| 4,113,012 | 9/1978 | Evans et al. | 166/264 |
| 4,197,879 | 4/1980 | Young | 166/324 |
| 4,422,506 | 12/1983 | Beck | 166/324 |
| 4,440,230 | 4/1984 | McGill | 166/324 X |
| 4,796,699 | 1/1989 | Upchurch | 166/250 |
| 4,886,115 | 12/1989 | Leggett et al. | 166/77 |

*Primary Examiner*—Thuy M. Bui
*Assistant Examiner*—Frank S. Tsay
*Attorney, Agent, or Firm*—Melvin A. Hunn

[57] ABSTRACT

An equalizing apparatus is provided for use in a wellbore tool string which includes a wireline-conveyable source of pressurized fluid which selectively discharges fluid, a wireline-conveyable fluid-pressure actuable wellbore tool which is operable in a plurality of modes of operation including at least a running mode of operation with the wireline-conveyable fluid-pressure actuable wellbore tool in a running condition and a actuated mode of operation with the wireline-conveyable fluid-pressure actuable wellbore tool in an actuated condition, a flow path for communicating fluid from the wireline-conveyable source of pressurized fluid and the wireline-conveyable fluid-pressure actuable wellbore tool, and a wireline assembly which is coupled thereto for delivery of the wireline-conveyable source of pressurized fluid and the wireline-conveyable fluid-pressure actuable wellbore tool to a selected location within a wellbore.

26 Claims, 8 Drawing Sheets

EQUALIZING APPARATUS FOR USE WITH WIRELINE-CONVEYABLE PUMPS

BACKGROUND OF THE INVENTION

1. Field of the Invention

This invention relates generally to wireline-conveyable wellbore tools, and specifically to a wellbore tool string which includes a wireline-conveyable source of pressurized fluid and a fluid-pressure actuable wellbore tool.

2. Description of the Prior Art

Fluid-actuated wellbore tools are widely known and used in oil and gas operations, in all phases of drilling, completion, and production. For example, in well completions and work-overs a variety of fluid-actuated packing devices are used, including inflatable packers and bridge plugs. In a work-over operation, a fluid actuated wellbore tool may be lowered into a desired location within the oil and gas well, downward through the internal bore of wellbore tubular strings such as tubing and casing strings.

Recent advances in the technology have allowed fluid-actuated wellbore tools to be lowered into the wellbore through the production tubing on either a wireline assembly or a coiled-tubing workstring. Coiled-tubing workstrings are usually coupled to a pumping unit disposed at the surface, which provides pressure to an actuating fluid which is usually, but not necessarily, a wellbore fluid. The pump at the surface of the wellbore usually has sufficiently high levels of pressure to completely, and reliably, actuate the fluid-actuated wellbore tool. In contrast, wireline-suspended pumps which are lowered into the wellbore are subject to stringent geometric constraints, particularly when intended for through-tubing operations, and are thus low-power devices, which are rather delicate in comparison with conventional pumps.

A number of fluid-actuable wellbore tools may be used with wireline-suspended pumps. For example, fluid-actuated inflatable packing devices, such as inflatable packers and bridge plugs, which include substantial elastomeric components, such as annular elastomeric sleeves, can be run into a wellbore in a deflated condition and be urged by pressurized wellbore fluids between the deflated running position and an inflated setting position. In the inflated setting position, the elastomeric components of wellbore packers and bridge plugs are essential in maintaining the wellbore tool in gripping engagement with wellbore surfaces.

It is frequently necessary or desirable to pressure test portions of wellbore tools, well head assemblies, or portions of the wellbore, with high but transient pressure levels. This is especially true in the use of wireline-conveyable wellbore tool strings, which are typically lowered into a wellbore through a lubricator apparatus which is coupled to the uppermost portion of a wellhead or blowout preventer. Before running the wireline-conveyed wellbore tool into the wellbore, it is desirable to perform a high pressure test of the lubricator by closing off a well head valve and pressurizing the lubricator up to ten thousand pounds per square inch of pressure with a gas. This pressure test of the wireline lubricator is typically performed with the entire wellbore tool string disposed within the lubricator. Therefore, high pressure gas may be urged into interior regions of the wellbore tool string, in communication with a pressure-actuable wellbore tool, such as an inflatable packer or bridge plug.

When the pressure test of lubricator is discontinued, pressure is bled off from the lubricator. However, gas which is disposed or trapped within portions of the wellbore tool string may expand, causing an unintentional and problematic actuation of the fluid-actuable wellbore tool. Typically, fluid-actuable wellbore tools are difficult or impossible to move from a radially-enlarged set position to a radially-reduced running position. Therefore, inadvertent setting of a fluid-actuated wellbore tool while it is disposed within the lubricator assembly will require that the lubricator assembly be dismantled or destroyed in order to remove the wellbore tool from within it. This is an extremely undesirable result, since it impedes the workover operation, results in damage to, or destruction of, the lubricator, and may require that replacement fluid actuated wellbore tools and lubricator assemblies be procured before the job can be continued.

SUMMARY OF THE INVENTION

It is one objective of the present invention to provide an equalizing apparatus for use in a wellbore tool string which includes an equalizing port for establishing fluid communication between an interior portion of the fluid-pressure actuable wellbore tool and the wellbore during a selected mode of operation, for maintaining the fluid-pressure actuable wellbore tool in a running condition and insensitive to unintentional or transient pressure differentials between an interior portion of the fluid-pressure actuable wellbore tool and the wellbore.

More particularly, it is another objective of the present invention to provide an equalizing port for establishing fluid communication between an interior portion of a fluid-pressure actuable wellbore tool and the interior region of a wireline lubricator assembly during a pressure testing mode of operation to maintain the fluid-pressure actuable wellbore tool in a running condition and insensitive to unintentional and transient pressure differentials between the interior portion of the fluid-pressure actuable wellbore tool and the wireline lubricator assembly.

It is yet another objective of the present invention to provide an equalizing apparatus for maintaining an interior portion of a fluid-pressure actuable wellbore tool in fluid communication with regions exterior of the tool, and which further includes a closure member which is responsive to pressurized fluid from a wireline-conveyed source of pressurized fluid for obstructing the equalizing port of the equalizing apparatus to discontinue fluid communication between the interior portion of the fluid-pressure actuable wellbore tool and the exterior region to allow build-up of pressure within the fluid-pressure actuable wellbore tool.

These and other objectives are achieved as is now described. An equalizing apparatus is provided for use in a wellbore tool string which includes a wireline-conveyable source of pressurized fluid which selectively discharges fluid, a wireline-conveyable fluid-pressure actuable wellbore tool which is operable in a plurality of modes of operation including at least a running mode of operation with said wireline-conveyable fluid-pressure actuable wellbore tool in a running condition and a actuated mode of operation with said wireline-conveyable fluid-pressure actuable wellbore tool in an actuated condition, means for communicating fluid from the wireline-conveyable source of pressurized fluid and the wireline-conveyable fluid-pressure actuable wellbore tool, and a wireline assembly which is coupled thereto for delivery of the wireline-conveyable source of pressurized fluid and the wireline-conveyable fluid-pressure actuable wellbore tool to a selected location within a wellbore.

Preferably, the equalizing apparatus includes a housing, and a means for coupling the housing to a selected portion of the wellbore tool string in fluid communication with the wireline-conveyable fluid-pressure actuable wellbore tool. An equalizing port is provided for establishing fluid communication between an interior portion of the wireline-conveyable fluid-pressure actuable wellbore tool and the region surrounding the wireline-conveyable fluid-pressure actuable wellbore tool during testing and running modes of operation, for maintaining the wireline-conveyable fluid-pressure actuable wellbore tool in a running condition and insensitive to unintentional and transient pressure differentials between an interior portion of the wireline-conveyable fluid-pressure actuable wellbore tool and the surrounding region.

A closure member is preferably also provided, which is responsive to pressurized fluid from the wireline-conveyable source of pressurized fluid for obstructing the equalizing port to discontinue fluid communication between the interior portion of the wireline-conveyable fluid-pressure actuable wellbore tool and the region surrounding the wireline-conveyable fluid-pressure actuable wellbore tool, to allow build-up of the pressure within the wireline-conveyable fluid-pressure actuable wellbore tool.

In the preferred embodiment of the present invention, a latch member is further provided for maintaining the closure member in a fixed and non-obstructing position relative to the equalizing port until the wireline-conveyable source of pressurized fluid is actuated to initiate switching of the wireline-conveyable fluid-pressure actuable wellbore tool between the running condition and the actuating condition. Also, in the preferred embodiment of the present invention, a tool volume expander member is provided which provides an additional volume which must be filled before overriding of a latch member is allowed, to prevent unintentional closure of the equalizing port.

Additional objectives, features, and advantages will be apparent in the written description which follows.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE INVENTION

Figure 1:
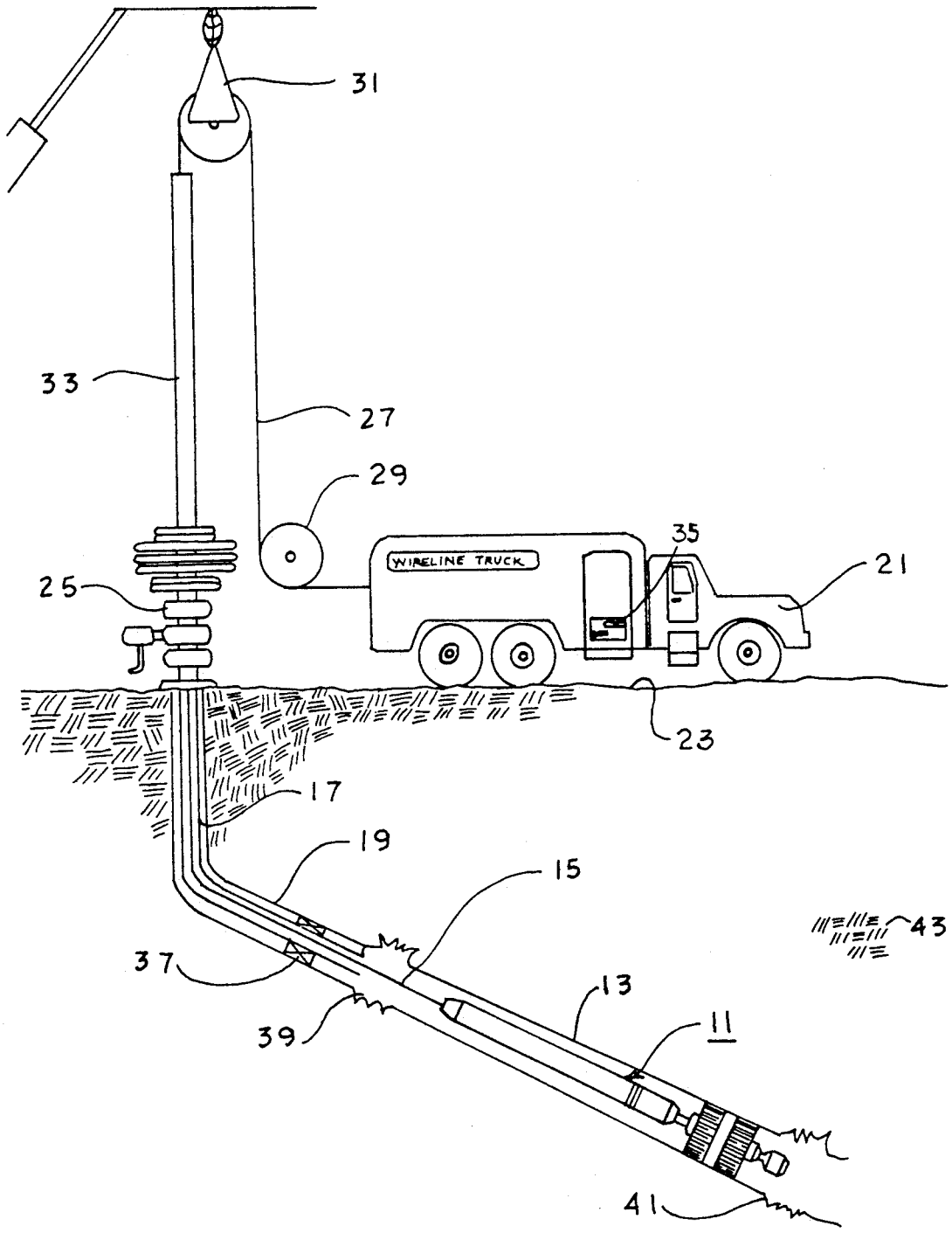
FIG. 1 is a simplified perspective and partial longitudinal section view of a wellbore tool string disposed within a wellbore on a wireline assembly, which includes the preferred equalizing apparatus of the present invention.

FIG. 1 is a schematic view of wellbore tool string 11 suspended within wellbore 13 on wireline assembly 15. Wellbore 13 includes production tubing string 19 concentrically disposed within casing 17. At the earth's surface 23, a conventional blowout preventer 25 is provided. Wireline assembly 15 includes wireline truck 21 which carries a spool of wireline cable, and an electric power supply 35, which supplies electric energy through electric cable 27 to selectively actuate an inflatable wellbore tool which is disposed at the lowermost end of wellbore tool string 11. Electric cable 27 is directed downward into wellbore 13 through guide wheel 29, pulley 31, conventional lubricator 33, and blowout preventer 25. As is conventional, production tubing string 19 is packed-off at its lower end with production packer 37. Perforations 39, 41 are provided in casing 17 to allow wellbore fluids to pass from formation 43 into wellbore 13.

Figure 2:
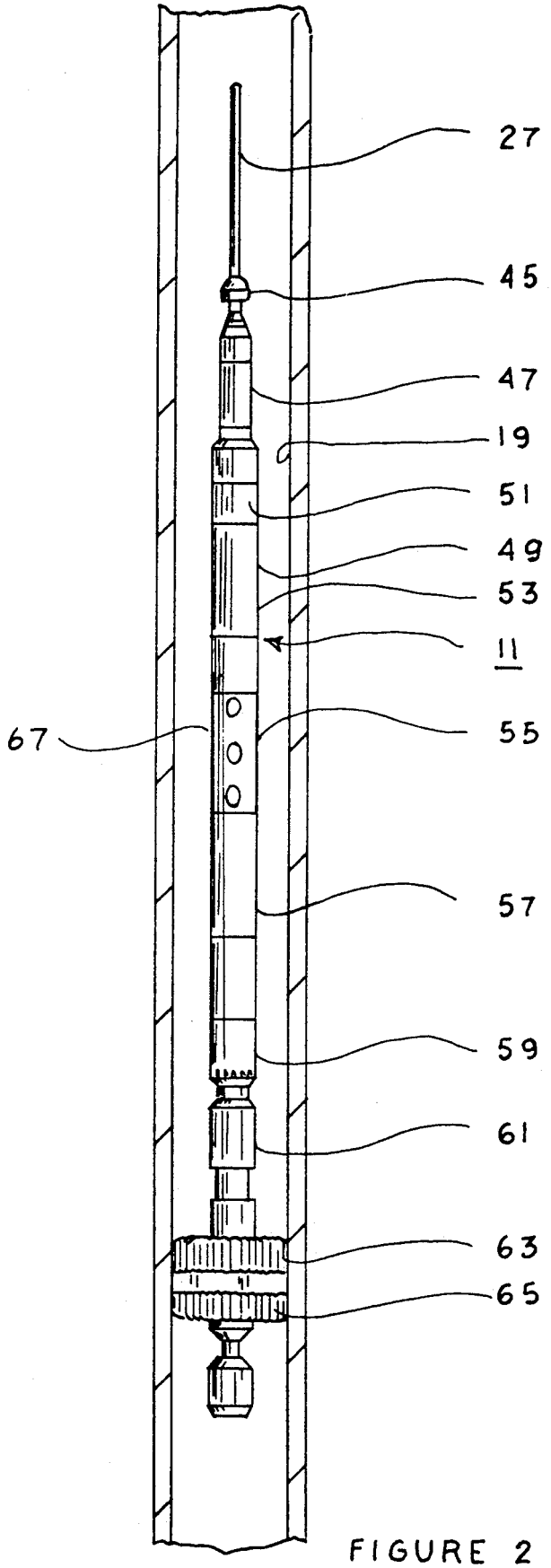
FIG. 2 is an enlarged view of the wellbore tool string of FIG. 1 disposed within the wellbore, with a bridge plug carried at the lowermost end of the wellbore tool string set against the wellbore casing.

FIG. 2 is an enlarged view of wellbore tool string 11, which is suspended by electric wireline cable 27 within casing 19 of wellbore 13. Rope socket connector 45 is disposed at the uppermost end of wellbore tool string 11 for providing a conventional coupling with electric wireline cable 27. Collar locator 47 is provided directly below rope socket connector 45, and is a conventional device which is used for locating wellbore tool string 11 relative to production tubing string 17 and casing 19. Typically, collar locator 47 is an electrical device which detects variation in magnetic flux due to the presence of tubing and casing collars. Preferably, wireline-conveyed pump 49 serves as a source of pressurized fluid, and includes three subassemblies including: motor subassembly 51; pump subassembly 53; and filter subassembly 55. Motor subassembly 51 includes a number of electrical motors which are energized by electricity provided from power supply 35 (of FIG. 1) via electric wireline cable 27 to wellbore tool string 11. A drive shaft extends downward from motor subassembly 51 to pump subassembly 53, and is energized by the electric motors disposed in motor subassembly 51, for actuating one or more fluid pumps which are disposed within pump subassembly 53. Filter subassembly 55 is provided below pump subassembly 53, and serves to receive wellbore fluids disposed in the vicinity of wellbore tool string 11, to filter the wellbore fluids to eliminate particulate matter suspended therein, and to direct the filtered wellbore fluid to an intake of the one or more pumps provided in pump subassembly 53. The central bore is provided within filter subassembly 55 for receiving pressurized wellbore fluids from the output of pump subassembly 53.

Equalizing subassembly 57, which includes the equalizing apparatus of the present invention, is coupled to the lowermost end of filter subassembly 55, and is in fluid communication with the central bore of filter subassembly 55, for receiving pressurized fluid from pump subassembly 53. Disconnect subassemblies 59, 61 are provided between equalizing subassembly 57 and the fluid-pressure actuable wellbore tool 63 (which is shown in FIGS. 1 and 2 as a bridge plug in the radially-enlarged setting position). Typically, fluid-pressure actuable wellbore tool 63 includes one or more elastomeric elements 65 which are expandable radially outward in response to pressurized fluid which is directed downward from pump subassembly 53, through equalizing subassembly 57, to a fluid receiving cavity within fluid-pressure actuable wellbore tool 63. While the fluid-pressure actuable wellbore tool 63 which is shown in FIGS. 1 and 2 is a bridge plug, this invention is not contemplated to be limited for use with bridge plugs, and can be used with other fluid-actuable wellbore tools including inflatable packer elements, valves, perforating guns, or other conventional fluid-actuable wellbore tools which are conveyable into a selected position within a wellbore on a wireline assembly.

Figure 3:
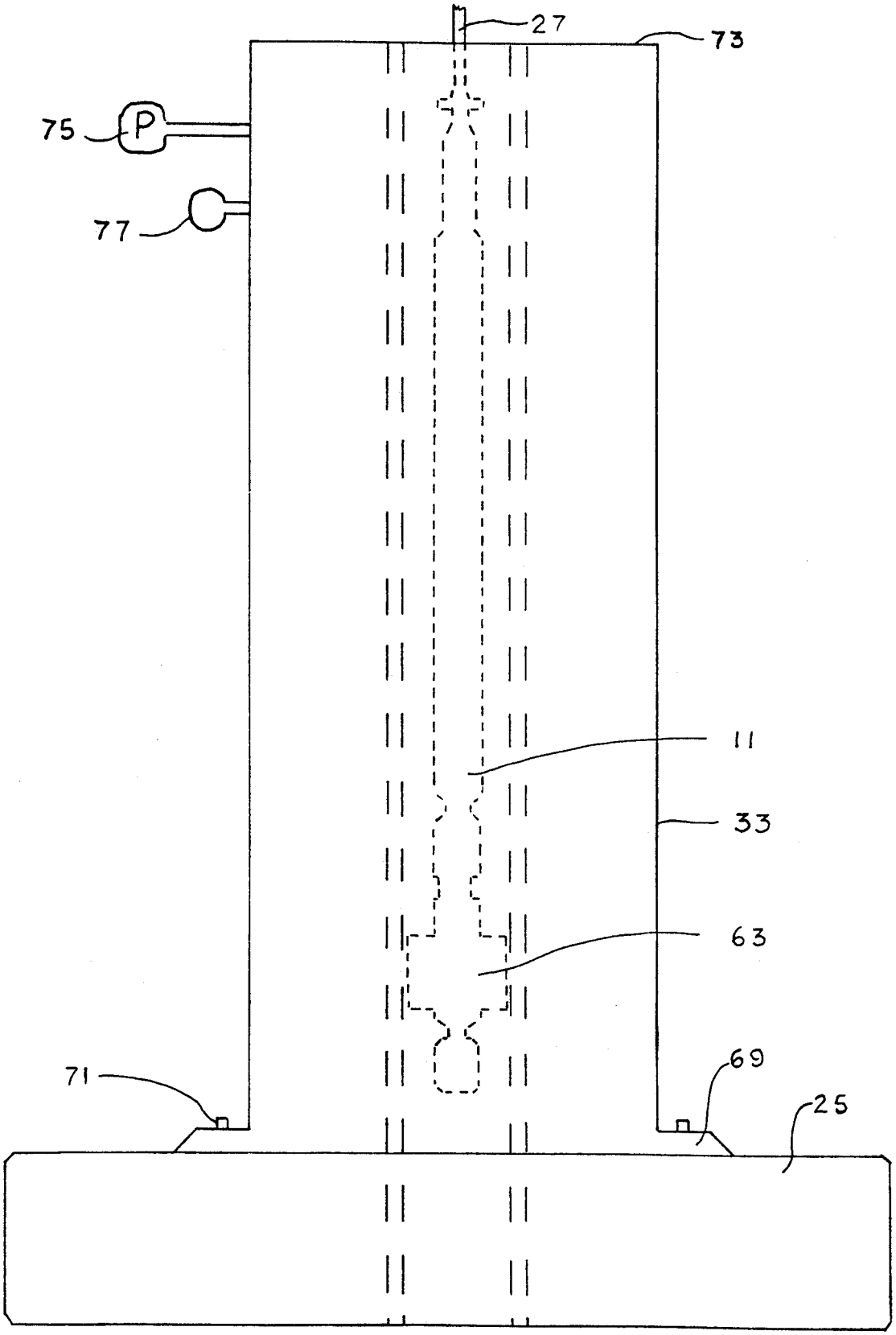
FIG. 3 is a simplified schematic view of a wireline lubricator during a pressure test mode of operation.

As discussed above, it is often desirable or necessary to pressure test lubricator 33 of FIG. 1 to determine if it is operating properly. FIG. 3 is a simplified schematic view of lubricator 33 of FIG. 1 with wellbore tool string 11 (shown in simplified form) suspended by electric wireline cable 27 therein. As is conventional, lubricator 33 is coupled at its lowermost end to blowout preventer 25, which is also shown in simplified form. As is conventional, blowout preventer 25 includes a wellhead valve which allows for manual closure of blowout preventer 25. Lubricator 33 is coupled by flange 69 to blowout preventer 25, with the interface being sealed by flange seal 71. At the uppermost end of lubricator 33, wireline stripper 73 is provided for providing a dynamic sealing engagement with electric wireline cable 27. Ports are also provided on lubricator 33 for selective coupling of pressure source 75 and gage 77. Pressure source 75 may be coupled to lubricator 33 to allow for pressure testing of lubricator 33.

Typically, gas may be used for high pressure testing, while fluid may be used for lower pressure testing. In either event, prior art devices which are not equipped with the equalizing apparatus of the present invention are susceptible to inadvertent and undesirable actuation of the fluid-actuable wellbore tool which is part of wellbore tool string 11. In a gas pressure testing of lubricator 33, test gas which enters wellbore tool string 11 will expand rapidly during bleed off of pressure from lubricator 33 at the end of pressure testing, causing inadvertent and undesirable actuation of fluid-actuable wellbore tool 63. When fluid is used to pressure test lubricator 33, gas from wellbore 13 may remain in lubricator 33, and likewise expand rapidly during bleed off of the fluid from lubricator 33 at the end of pressure testing. This will also cause a rapid, unintentional, and undesirable expansion of fluid-actuable wellbore tool 63 of wellbore tool string 11. As discussed above, the equalizing apparatus of the present invention overcomes this problem, and prevents unintentional and undesirable actuation of fluid-pressure actuable wellbore tool 63 while in lubricator 33 during and after pressure testing, but also prevents accidental or unintentional actuation of fluid-pressure actuable wellbore tool 63 in other pressure testing or transient pressure differential conditions both inside and outside of the lubricator 33.

Figure 4:
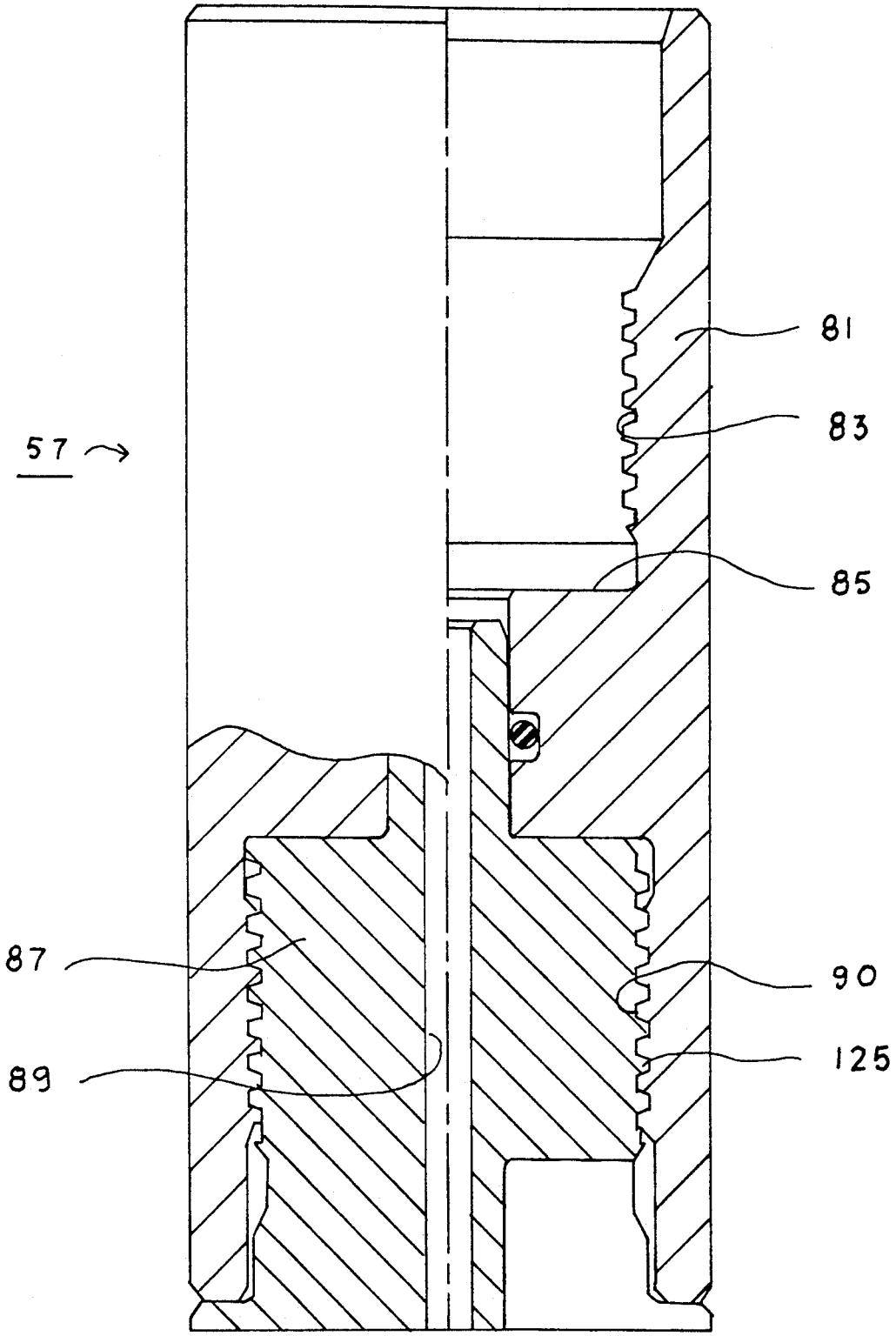
FIGS. 4 through 8 are fragmentary and one-quarter longitudinal section views of the preferred equalizing apparatus of the present invention.
Figure 5:
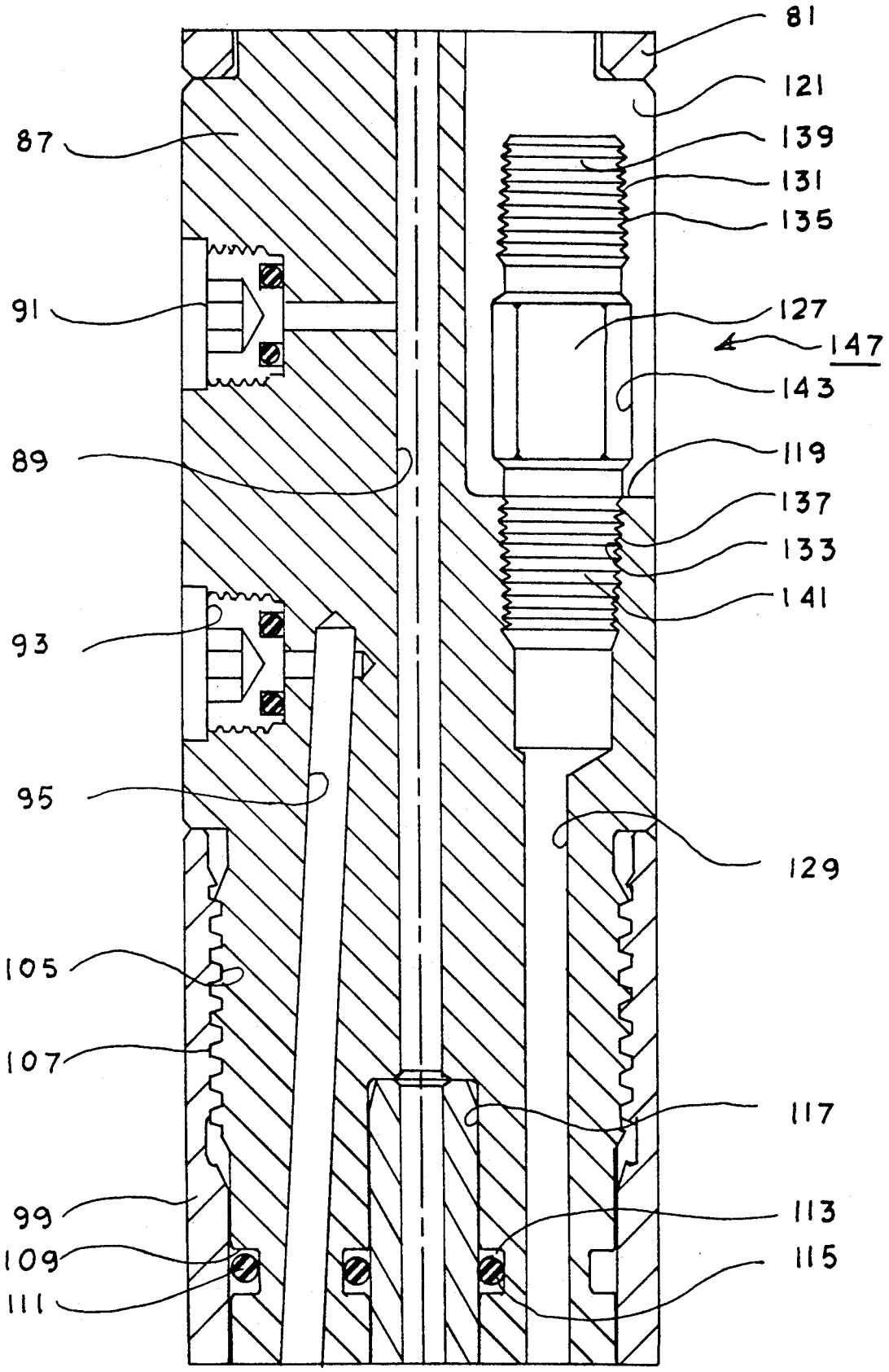
Figure 6:
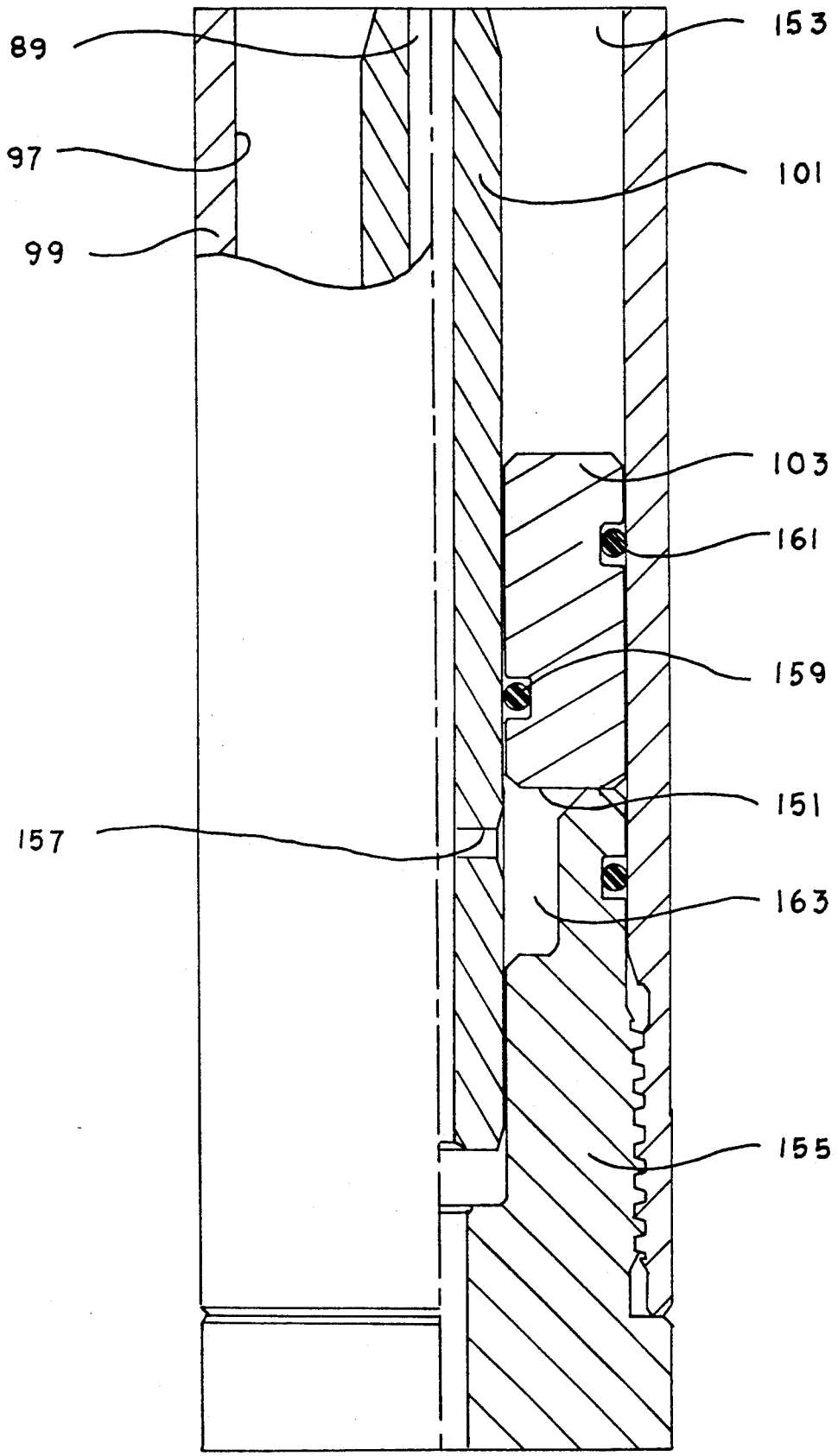
Figure 7:
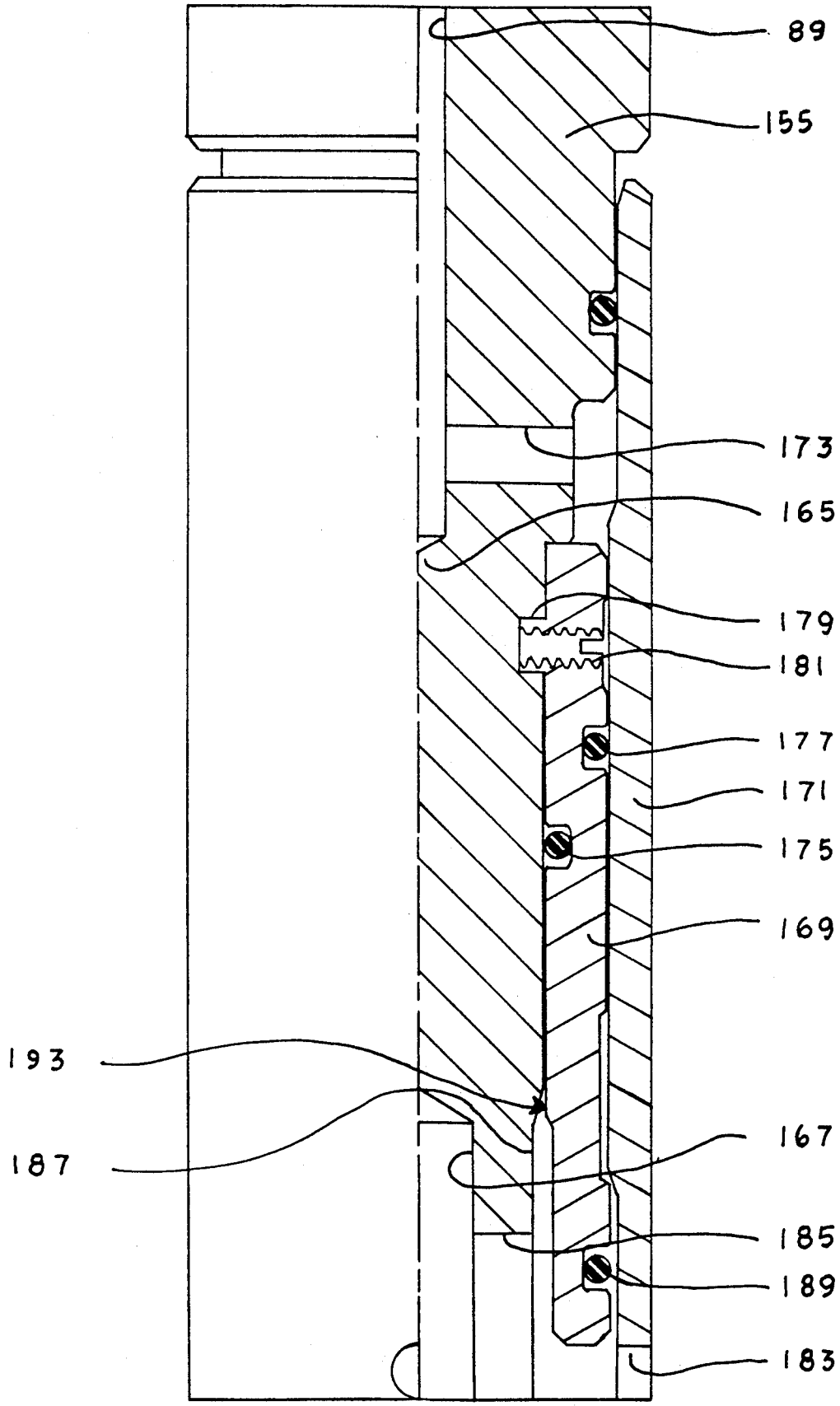
Figure 8:
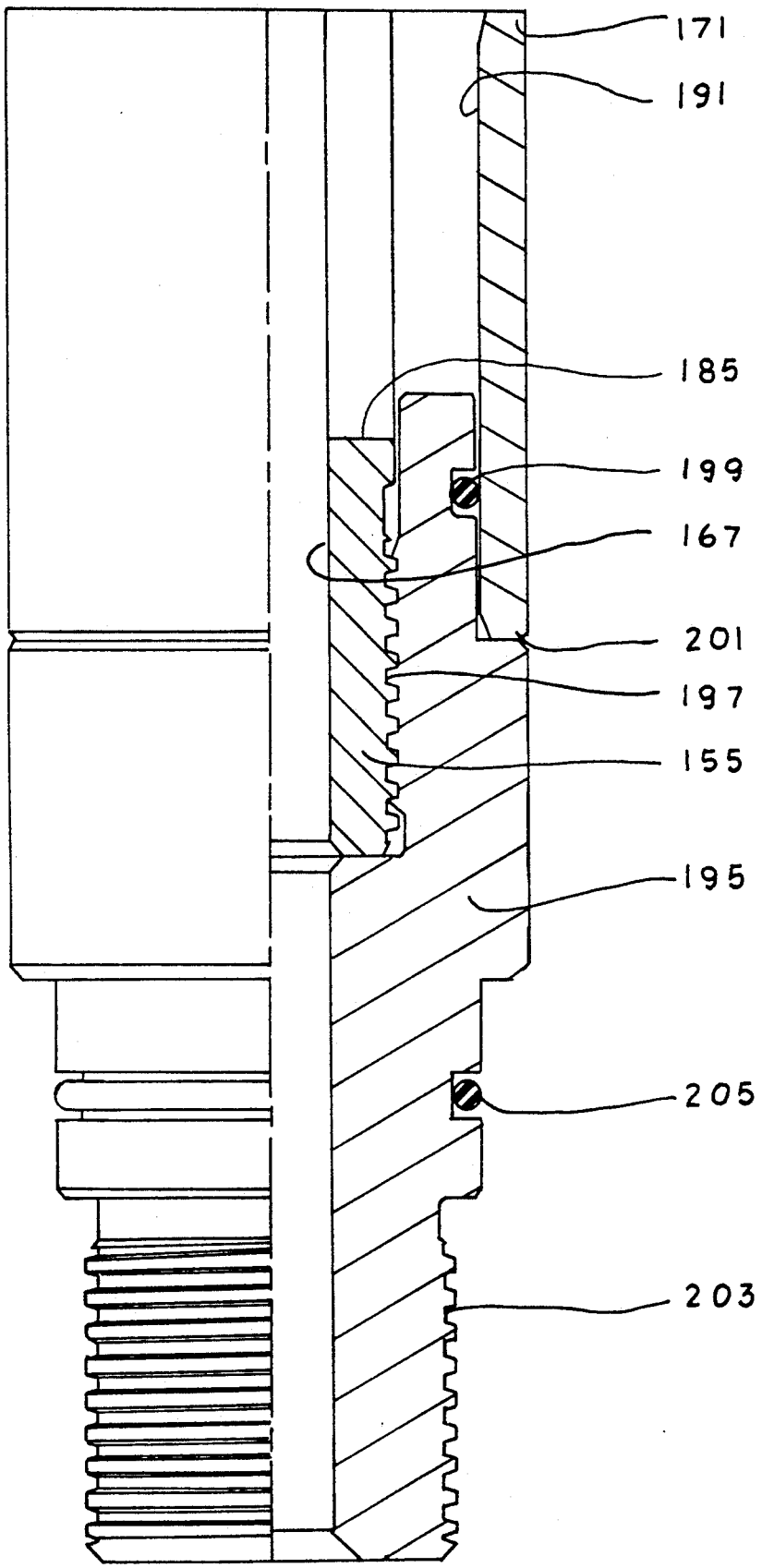

FIGS. 4 through 8 provide fragmentary and one-quarter longitudinal section views of portions of the preferred equalizing subassembly 57, of the present invention, with FIG. 4 providing a view of the uppermost portion of equalizing subassembly 57, and FIG. 8 providing a view of the lowermost portion of equalizing subassembly 57, and with FIGS. 5, 6, and 7 providing intermediate views of equalizing subassembly 57. FIGS. 4 through 8 can be read together from top to bottom to provide a complete view of the preferred equalizing subassembly 57 of the present invention.

With reference first to FIG. 4, upper collar 81 includes internal threads 83 and internal shoulder 85, and defines a box-type connector for releasably coupling with the lowermost end of filter subassembly 55. The lowermost end of upper collar 81 includes internal threads 90 which are adapted for releasably engaging external threads 125 of central body 87 which has a longitudinally extending central bore 89 for communicating fluid from the output of wireline conveyed pump 49 to a fluid-pressure actuable wellbore tool disposed at the lowermost end of wellbore string 11.

As is shown in FIG. 5, central body 87 includes a pressure relief port 91, which allows the operator to bleed off the pressure within central bore 89 of central body 87 after the tool is retrieved from the wellbore. Central body 87 further includes filling port 93, which is a conventional valve which allows for selective access to fill conduit 95, which allows the user to fill cavity 97 (of FIG. 6) with a substantially incompressible fluid.

Preferably, cavity 97 is annular shaped, and is defined (in the region depicted in FIG. 6) between outer sleeve 99 and inner sleeve 101. Inner sleeve 101 has central bore 89 extending longitudinally therethrough. At the uppermost end of outer sleeve 99, internal threads 105 are provided for coupling with external threads 107 at the lowermost end of central body 87. Fill conduit 95 extends downward from fill port 93 substantially parallel with central bore 89. O-ring cavity 109 is provided at the lowermost portion of central body 87 and is adapted for receiving O-ring seal 111 which seals the interface of outer sleeve 99 and central body 87. The lowermost end of central body 87 is also equipped with interior O-ring seal cavity 113 which is adapted for receiving O-ring seal 115, for providing a seal tight engagement between inner sleeve 101 and central body 87 at mating recess 117 of central body 87.

It should be noted that equalizing subassembly 57 is not axially symmetrical in the portions depicted in FIGS. 4 and 5. As shown in FIG. 5, the right hand portion of equalizing subassembly 57 includes valve cavity 119 which is adapted for receiving valve body 121, which is semi-circular in cross-section view. Valve body 121 is adapted for receiving pressure relief valve 127 which includes upper and lower pin ends 139, 141, with external threads 135, 137. The largest portion of pressure relief valve 127 resides in valve cavity 143 of valve body 121, and mates with threaded cavity portion 131 to secure pressure release valve 127 in place relative to valve body 121. Lower end 141 of pressure relief valve 127 extends into the upper end of flow passage 129 and mates with threaded cavity portion 133. Pressure relief valve 127 is adapted for remaining in simultaneous fluid communication with flow passage 129 and an exterior region 147. Pressure relief valve 127 is preferably set to move between a normally-closed operating position to an open position upon sensing pressure in the region of flow passage 129 which exceeds one hundred and fifty (150) pounds per square inch. Of course, differing pressure relief valves can be selected to provide a pressure relief threshold which suits particular operating needs.

As is shown in FIG. 6, piston member 103 is disposed in the annular region of cavity 97 at lower end 151, in abutment with plug member 155. Substantially incompressible fluid is disposed between piston member 103 and upper end 153 of cavity 97. Plug member includes interior and exterior O-ring seals 159, 161 for respective engagement with the interior surface of outer sleeve 99 and the exterior surface of inner sleeve 101. Pressurized fluid may be pumped downward through central bore 89 from wireline conveyed pump 49, through port 57 into annular region 163 which is disposed between the lowermost end of piston member 103 and plug member 155. When the output pressure from wireline conveyed pump 49 within central bore 89 exceeds the selected pressure threshold for pressure relief valve 127, pressure relief valve 127 will open, allowing discharge of the substantially incompressible fluid from cavity 97, and corresponding upward movement of piston member 103 from lower end 151 to upper end 153 of cavity 97. In the running mode of operation, piston member 103 is disposed at lower end 151 of cavity 97. During the testing of lubricator 33, central bore 89 is not in fluid communication with lubricator 33. As can be seen from FIG. 7, the central bore terminates at plug portion 165 of plug member 155. As is shown in FIG. 7, central bore 89 communicates with closure port 173, which extends radially outward, and allows application of fluid pressure to the uppermost end of closure member 169, which is disposed in the annular region between the lowermost portion of plug member 155 and equalizing port sleeve 177, and is an annular shaped sleeve. Interior and exterior O-ring seals 175, 177 are provided respectively on the interior and exterior surfaces of closure member 169, and are adapted for dynamically and sealingly engaging respectively the exterior surface of plug member 155 and the interior surface of equalizing port sleeve 171.

Shear pin cavity 179 is disposed on the exterior surface of plug member 155, and is adapted for receiving threaded shear pin 181. Preferably, threaded shear pin 181 is adapted for shearing upon application of one thousand-five hundred pounds per square inch of force upon the uppermost end of closure member 169. During a running mode of operation, closure member 169 is maintained in a fixed position relative to plug member 155 by operation of threaded shear pin 181. In this condition, passage of fluid is allowed between tool conduit 167, which communicates with the fluid-pressure actuated wellbore tool, tool port 185, and equalizing port 183. While closure member 169 is maintained in this position, no pressure differential will exist between the interior of the fluid-pressure actuated wellbore tool and a region exterior of the tool. Therefore, during pressure testing, no pressure differential exists between lubricator 33 and the fluid-pressure actuable wellbore tool. Consequently, when pressure is bled-off of lubricator 33, no pressure differential will exist, and no inflation of fluid-pressure actuable wellbore tool can occur.

If pressurized gas enters wireline conveyed pump 49, or other tool members above, during pressure testing in lubricator 33, bleeding off of the test pressure will cause the trapped gas to expand and apply pressure to the uppermost end of closure member 169. If the force is great enough, it could cause an unintended closure of equalizing port 183.

A safety feature is provided by pressure relief valve 127, cavity 91 and piston member 103. Trapped gas which communicates with central bore 89 will also act upon the lowermost end of piston member 103 and through the substantially incompressible fluid in cavity 97 upon pressure relief valve 127. Since pressure relief valve 127 is set to move between a normally-closed position and open position at one hundred and fifty pounds per square inch of force and threaded shear pin 181 is adapted to shear at one thousand-five hundred pounds per square inch of force, piston member 103 will begin traveling upward before threaded shear pin 181 is sheared, providing an additional volume (of cavity 97) for receipt of the expanding gas causing a diminishment of the force upon the uppermost end of closure member 169. If the volume of cavity 97 is large enough, threaded shear pin 181 will never be sheared accidentally during pressure testing. The ideal volume for cavity 97 can be determined by routine calculations using the ideal gas law which interrelates pressure and volume ($P_1V_1=P_2V_2$, at a constant temperature).

More specifically, the maximum volume available for entrapment of gas is known, as is the maximum possible pressure level for the gas during testing of the lubricator 33 (as stated above, testing pressures extend up to ten thousand pounds per square inch of pressure). The maximum permissible force level is also known, and corresponds to the force needed to shear threaded shear pin 181 (which is preferably one thousand-five hundred pounds of force) and the area of contact of closure member 169 with the trapped gas. Simple calculations will yield the total volume needed for cavity 97 to ensure that trapped gas never exerts a force on closure member 169 which would cause an unintended shearing of threaded shear pin 181. Access to cavity 97 is triggered by application of a force from the gas which exceeds one hundred and fifty pounds per square inch to the lowermost end of piston member 103 and allows evacuation of incompressible fluid from cavity 97 as gas fills cavity 97.

Once wellbore tool string 11 is lowered within wellbore 13 to a desired location, it becomes an operating objective to actuate the fluid-pressure actuable wellbore tool to expand it from a radially-reduced running mode of operation to a radially-expanded setting mode of operation for setting against a selected wellbore surface, such as casing 19 (such as is shown in FIG. 1). Of course, actuation of the fluid-pressure actuable wellbore tool cannot occur until the equalizing valve of equalizing subassembly 57 is urged between open and closed positions.

Closing of the equalizing valve can be accomplished by electrically actuating wireline conveyed pump 49 to direct pressurized fluid downward through central bore 89, urging fluid through closure port 173 for application of fluid pressure to the uppermost end of closure member 169. Once one hundred and fifty pounds per square inch of pressure is obtained, pressure relief valve 127 will move from the normally-closed position to the open position, and allow discharge of the substantially incompressible fluid disposed in cavity 97, thus allowing piston member 103 to travel upward from lower end 151 to upper end 153.

As stated above, in the preferred embodiment of the present invention, pressure release valve 127 is actuated at one hundred and fifty pounds per square inch of pressure. Once piston member 103 traverses completely upward through cavity 97 to upper end 153, fluid pressure continues to build at the upper end of closure member 169, until fluid pressure of one thousand-five hundred pounds per square inch is obtained, upon which threaded shear pin 181 shears, allowing downward displacement of closure member 169 relative to plug member 155 and equalizing port sleeve 171. The exterior surface of plug member 155 includes tapered region 187 which allows O-ring seal 175 to come out of sealing engagement with the exterior surface of plug member 155. As this occurs, O-ring seal 189, which is carried on the exterior surface, and at the lowermost end, of closure member 169 will come into sealing engagement with sealing region 191 on the interior surface of equalizing port sleeve 171. As a consequence, equalizing port 183 is sealed from below by O-ring seal 189, and from above by O-ring seal 177, which together straddle equalizing port 183. Another consequence is that flow path 193 is established between central bore 89 closure port 173, tool port 185, and tool conduit 167, to allow pressurized wellbore fluid to be directed downward from wireline conveyed pump 49 to the fluid-pressure actuable wellbore tool which is disposed therebelow.

FIG. 8 depicts lower collar 195, and the threaded coupling 197 between the lowermost end of plug member 155, and lower collar 195. FIG. 8 also depicts the sealing engagement between the uppermost end of lower collar 195 and equalizing port sleeve 171. As shown, lower collar 195 forms external shoulder 201 for receiving the lowermost end of equalizing port sleeve 171. Furthermore, lower collar 195 includes external threads 203 and O-ring seal 205 which are adapted for providing a threaded and sealing coupling with the uppermost end of disconnect subassembly 59 which allows disconnection of fluid-pressure actuated wellbore tool 63 from the remainder of wellbore tool string 11.

While the invention has been shown in only one of its forms, it is not thus limited but is susceptible to various changes and modifications without departing from the spirit thereof. j

What is claimed is:

1. In a wellbore tool string including:

a wireline-conveyable source of pressurized fluid which selectively discharges fluid;

a wireline-conveyable fluid-pressure actuable wellbore tool which is operable in a plurality of modes of operation, including at least a running mode of operation with said fluid-pressure actuable wellbore tool in a running condition and an actuated mode of operation with said fluid-actuable wellbore tool in an actuated condition;

means for communication fluid from said wireline-conveyable source of pressurized fluid to said wireline-conveyable fluid-pressure actuable wellbore tool; and a wireline assembly which is coupled thereto for delivery of said wireline-conveyable source of pressurized fluid, said fluid-pressure actuable wellbore tool;

an equalizing apparatus comprising:

(a) a housing;

(b) means for coupling said equalizing apparatus to a selected portion of said wellbore tool string in fluid communication with at least said fluid-pressure actuable wellbore tool;

(c) an equalizing port for establishing fluid communication between an interior portion of said fluid-pressure actuable wellbore tool and a region exterior of said wellbore tool string during said running mode of operation and for maintaining said fluid-pressure actuable wellbore tool in a running condition and insensitive to unintentional and transient pressure differentials between said interior portion of said fluid-pressure actuable wellbore tool and said region exterior of said wellbore tool string; and (d) a selectively-actuable closure member for obstructing said equalizing port to discontinue fluid communication between said interior portion of said fluid-pressure actuable wellbore tool and said region exterior of said wellbore tool string to allow build up to pressure within said fluid-pressure actuable wellbore tool.

2. An equalizing apparatus according to claim 1, further comprising:

(e) a latch member for maintaining said selectively-actuable closure member in a fixed and non-obstructing position relative to said equalizing port until said wireline-conveyable source of pressurized fluid is actuated to initiate switching of said fluid-pressure actuable wellbore tool between said running condition and said actuated condition.

3. An equalizing apparatus according to claim 1, wherein during said running mode of operation said selectively-actuable closure member blocks fluid communication between said fluid-pressure actuable wellbore tool and said wireline-conveyable source of pressurized fluid.

4. An equalizing apparatus according to claim 1, further comprising:

(e) a latch member for maintaining said selectively-actuable closure member in a fixed and non-obstructing position relative to said equalizing port until said wireline-conveyable source of pressurized fluid is actuated to initiate switching of said fluid-pressure actuable wellbore tool between said running condition and said actuated condition; and (f) a volume expander member which provides a cavity which diminishes force transfer from gas trapped within said wireline-conveyable source of pressurized fluid to said latch member to allow said latch member to maintain said selectively-actuable closure member in a fixed and non-obstructing position to prevent unintentional closure of said equalizing port.

5. An equalizing apparatus according to claim 2, wherein said selectively-actuable closure member comprises a sleeve which blocks a fluid flow path between said wireline-conveyable source of pressurized fluid and said fluid-pressure actuable wellbore tool and wherein said latch member comprises a shearable fastener which holds said sleeve in a fluid blocking position until a preselected pressure level is applied to said selectively-actuable closure member.

6. An equalizing apparatus according to claim 1, wherein said selectively-actuable closure member includes seal members for isolating and sealing said equalizing port when said selectively-actuable closure member is in obstructing relation with said equalizing port.

7. An equalizing apparatus according to claim 4, wherein said volume expander member includes:

(a) a cavity having first and second ends;

(b) a piston member disposed in said cavity at said first end;

(c) a substantially incompressible fluid for filling said cavity between said piston member and said second end of said cavity;

(d) a normally-closed pressure relief valve in communication with said substantially incompressible fluid in said cavity, which is urgable to an open position when said substantially incompressible fluid obtains a preselected pressure level;

(e) conduit means for providing fluid communication between said wireline-conveyable source of pressurized fluid and said first end of said cavity for applying force from said gas to said piston member; and (f) wherein said substantially incompressible fluid and said normally-closed pressure relief valve together prevent movement of said piston member within said cavity until said force from said gas which is applied to said piston member exceeds said preselected pressure level of said normally-closed pressure relief valve to urge said normally-closed pressure relief valve to said open position to allow venting of said substantially incompressible fluid and movement of said piston member relative to said cavity thus allowing said cavity to receive said gas.

8. An equalizing apparatus according to claim 7, wherein travel of said piston from said first end to said second end of said cavity provides a selected volume for receipt of expanding gas to minimize risk of unintentional closure of said selectively-actuable closure member.

9. In a wellbore tool string including:

a wireline-conveyable source of pressurized fluid which selectively discharges fluid;

a wireline-conveyable fluid-pressure actuable wellbore tool which is operable in a plurality of modes of operation, including at least a running mode of operation with said fluid-pressure actuable wellbore tool in a running condition and an actuated mode of operation with said fluid-actuable wellbore tool in an actuated condition;

means for communication fluid from said wireline-conveyable source of pressurized fluid to said wireline-conveyable fluid-pressure actuable wellbore tool;

a wireline assembly which is coupled thereto for delivery of said wireline-conveyable source of pressurized fluid, said fluid-pressure actuable wellbore tool;

an equalizing apparatus comprising:

(a) a housing;

(b) means for coupling said equalizing apparatus to a selected portion of said wellbore tool string in fluid communication with said wireline-conveyable source of pressurized fluid and said fluid-pressure actuable wellbore tool;

(c) an equalizing port for establishing fluid communication between an interior portion of said fluid-pressure actuable wellbore tool and a region exterior of said wellbore tool string during said running mode of operation for maintaining said fluid-pressure actuable wellbore tool in a running condition and insensitive to unintentional and transient pressure differentials between an interior portion of said fluid-pressure actuable wellbore tool and said region exterior of said wellbore tool string; and (d) a closure member which is responsive to pressurized fluid from said wireline-conveyable source of pressurized fluid for obstructing said equalizing port to discontinue fluid communication between said interior portion of said fluid-pressure actuable wellbore tool and said region exterior of said wellbore tool string to allow build up of pressure within said fluid-pressure actuable wellbore tool, but which is insensitive to force from gas in communication with said closure member.

10. An equalizing apparatus according to claim 9, further comprising:

(e) a latch member for maintaining said closure member in a fixed and non-obstructing position relative to said equalizing port until said wireline-conveyable source of pressurized fluid is actuated to initiate switching of said fluid-pressure actuable wellbore tool between said running condition and said actuated condition.

11. An equalizing apparatus according to claim 9, wherein during said running mode of operation said closure member blocks fluid communication between said fluid-pressure actuable wellbore tool and said wireline-conveyable source of pressurized fluid.

12. An equalizing apparatus according to claim 9, further comprising:

(e) a latch member for maintaining said closure member in a fixed and non-obstructing position relative to said equalizing port until said wireline-conveyable source of pressurized fluid is actuated to initiate switching of said fluid-pressure actuable wellbore tool between said running condition and said actuated condition; and (f) a volume expander member which selectively receives gas in communication with said closure member to diminish the effect of gas trapped within said wireline-conveyable source of pressurized fluid upon said latch member to allow said latch member to maintain said closure member in a fixed and non-obstructing position and prevent unintentional closure of said equalizing port.

13. An equalizing apparatus according to claim 12, wherein said volume expander member includes:

(a) a cavity having first and second ends;

(b) a piston member disposed in said cavity at said first end;

(c) a substantially incompressible fluid for filling said cavity between said piston member and said second end of said cavity;

(d) a normally-closed pressure relief valve in communication with said substantially incompressible fluid in said cavity, which is urgable to an open position when said substantially incompressible fluid obtains a preselected pressure level;

(e) conduit means for providing fluid communication between said wireline-conveyable source of pressurized fluid and said first end of said cavity for applying pressurized fluid to said piston member;

(f) wherein said substantially incompressible fluid and said normally-closed pressure relief valve together prevent movement of said piston member within said cavity until pressure from said wireline-conveyable source of pressurized fluid which is applied to said piston member exceeds said preselected pressure level of said normally-closed pressure relief valve to urge said normally-closed pressure relief valve to said open position to allow venting of said substantially incompressible fluid and movement of said piston member relative to said cavity; and (g) wherein alternately said substantially incompressible fluid and said normally-closed pressure relief valve together prevent movement of said piston member within said cavity until pressure from said gas which is trapped within said wireline-conveyable source of pressurized fluid which is applied to said piston member exceeds said preselected pressure level of said normally-closed pressure relief valve to urge said normally-closed pressure relief valve to said open position to allow venting of said substantially incompressible fluid and movement of said piston member relative to said cavity to allow said cavity to receive said gas.

14. In a wellbore tool string including:

a source of pressurized fluid which selectively discharges fluid;

a fluid-pressure actuable wellbore tool which is operable in a plurality of modes of operation, including at least a running mode of operation with said fluid-pressure actuable wellbore tool in a running condition and an actuated mode of operation with said fluid-actuable wellbore tool in an actuated condition;

means for communication fluid from said source of pressurized fluid to said fluid-pressure actuable wellbore tool; and a delivery mechanism for selectively raising and lowering said source of pressurized fluid and said fluid-pressure actuable wellbore tool to selected locations within said wellbore;

an equalizing apparatus comprising:

(a) a housing;

(b) means for coupling said equalizing apparatus to a selected portion of said wellbore tool string in fluid communication with at least said fluid-pressure actuable wellbore tool;

(c) an equalizing port for establishing fluid communication between an interior portion of said fluid-pressure actuable wellbore tool and a region exterior of said wellbore tool string during said running mode of operation and for maintaining said fluid-pressure actuable wellbore tool in a running condition and insensitive to unintentional and transient pressure differentials between said interior portion of said fluid-pressure actuable wellbore tool and said region exterior of said wellbore tool string; and (d) a selectively-actuable closure member for obstructing said equalizing port to discontinue fluid communication between said interior portion of said fluid-pressure actuable wellbore tool and said region exterior of said wellbore tool string to allow build up of pressure within said fluid-pressure actuable wellbore tool.

15. An equalizing apparatus according to claim 14, further comprising:

(e) a latch member for maintaining said selectively-actuable closure member in a fixed and non-obstructing position relative to said equalizing port until said source of pressurized fluid is actuated to initiate switching of said fluid-pressure actuable wellbore tool between said running condition and said actuated condition.

16. An equalizing apparatus according to claim 14, wherein during said running mode of operation said selectively-actuable closure member blocks fluid communication between said fluid-pressure actuable wellbore tool and said source of pressurized fluid.

17. An equalizing apparatus according to claim 14, further comprising:

(e) a latch member for maintaining said selectively-actuable closure member in a fixed and non-obstructing position relative to said equalizing port until said source of pressurized fluid is actuated to initiate switching of said fluid-pressure actuable wellbore tool between said running condition and said actuated condition; and (f) means for diminishing force transfer from gas trapped within said source of pressurized fluid to said equalizing apparatus.

18. An equalizing apparatus according to claim 15, wherein said selectively-actuable closure member comprises a sleeve which blocks a fluid flow path between said source of pressurized fluid and said fluid-pressure actuable wellbore tool and wherein said latch member comprises a shearable fastener which holds said sleeve in a fluid blocking position until a preselected pressure level is applied to said selectively-actuable closure member.

19. An equalizing apparatus according to claim 14, wherein said selectively-actuable closure member includes seal members for isolating and sealing said equalizing port when said selectively-actuable closure member is in obstructing relation with said equalizing port.

20. An equalizing apparatus according to claim 17, wherein said volume expander member includes:

(a) a cavity having first and second ends;

(b) a piston member disposed in said cavity at said first end;

(c) a substantially incompressible fluid for filling said cavity between said piston member and said second end of said cavity;

(d) a normally-closed pressure relief valve in communication with said substantially incompressible fluid in said cavity, which is urgable to an open position when said substantially incompressible fluid obtains a preselected pressure level;

(e) conduit means for providing fluid communication between said source of pressurized fluid and said first end of said cavity for applying force from said gas to said piston member; and (f) wherein said substantially incompressible fluid and said normally-closed pressure relief valve together prevent movement of said piston member within said cavity until said force from said gas which is applied to said piston member exceeds said preselected pressure level of said normally-closed pressure relief valve to urge said normally-closed pressure relief valve to said open position to allow venting of said substantially incompressible fluid and movement of said piston member relative to said cavity thus allowing said cavity to receive said gas.

21. An equalizing apparatus according to claim 20, wherein travel of said piston from said first end to said second end of said cavity provides a selected volume for receipt of expanding gas to minimize risk of unintentional closure of said selectively-actuable closure member.

22. In a wellbore tool string including:

a source of pressurized fluid which selectively discharges fluid;

a fluid-pressure actuable wellbore tool which is operable in a plurality of modes of operation, including at least a running mode of operation with said fluid-pressure actuable wellbore tool in a running condition and an actuated mode of operation with said fluid-actuable wellbore tool in an actuated condition;

means for communication fluid from said source of pressurized fluid to said fluid-pressure actuable wellbore tool; and means for delivery of said source of pressurized fluid, said fluid-pressure actuable wellbore tool;

an equalizing apparatus comprising:

(a) a housing;

(b) means for coupling said equalizing apparatus to a selected portion of said wellbore tool string in fluid communication with said source of pressurized fluid and said fluid-pressure actuable wellbore tool;

(c) an equalizing port for establishing fluid communication between an interior portion of said fluid-pressure actuable wellbore tool and a region exterior of said wellbore tool string during said running mode of operation for maintaining said fluid-pressure actuable wellbore tool in a running condition and insensitive to unintentional and transient pressure differentials between an interior portion of said fluid-pressure actuable wellbore tool and said region exterior of said wellbore tool string; and (d) a closure member which is responsive to pressurized fluid from said source of pressurized fluid for obstructing said equalizing port to discontinue fluid communication between said interior portion of said fluid-pressure actuable wellbore tool and said region exterior of said wellbore tool string to allow build up of pressure within said fluid-pressure actuable wellbore tool, but which is insensitive to force from gas in communication with said closure member.

23. An equalizing apparatus according to claim 22, further comprising:

(e) a latch member for maintaining said closure member in a fixed and non-obstructing position relative to said equalizing port until said source of pressurized fluid is actuated to initiate switching of said fluid-pressure actuable wellbore tool between said running condition and said actuated condition.

24. An equalizing apparatus according to claim 22, wherein during said running mode of operation said closure member blocks fluid communication between said fluid-pressure actuable wellbore tool and said source of pressurized fluid.

25. An equalizing apparatus according to claim 22, further comprising:

(e) a latch member for maintaining said closure member in a fixed and non-obstructing position relative to said equalizing port until said source of pressurized fluid is actuated to initiate switching of said fluid-pressure actuable wellbore tool between said running condition and said actuated condition; and (f) a volume expander member which selectively receives gas in communication with said closure member to diminish the effect of gas trapped within said source of pressurized fluid upon said latch member to allow said latch member to maintain said closure member in a fixed and non-obstructing position and prevent unintentional closure of said equalizing port.

26. An equalizing apparatus according to claim 25, wherein said volume expander member includes:

(a) a cavity having first and second ends;

(b) a piston member disposed in said cavity at said first end;

(c) a substantially incompressible fluid for filling said cavity between said piston member and said second end of said cavity;

(d) a normally-closed pressure relief valve in communication with said substantially incompressible fluid in said cavity, which is urgable to an open position when said substantially incompressible fluid obtains a preselected pressure level;

(e) conduit means for providing fluid communication between said source of pressurized fluid and said first end of said cavity for applying pressurized fluid to said piston member;

(f) wherein said substantially incompressible fluid and said normally-closed pressure relief valve together prevent movement of said piston member within said cavity until pressure from said source of pressurized fluid which is applied to said piston member exceeds said preselected pressure level of said normally-closed pressure relief valve to urge said normally-closed pressure relief valve to said open position to allow venting of said substantially incompressible fluid and movement of said piston member relative to said cavity; and (g) wherein alternately said substantially incompressible fluid and said normally-closed pressure relief valve together prevent movement of said piston member within said cavity until pressure from said gas which is trapped within said source of pressurized fluid which is applied to said piston member exceeds said preselected pressure level of said normally-closed pressure relief valve to urge said normally-closed pressure relief valve to said open position to allow venting of said substantially incompressible fluid and movement of said piston member relative to said cavity to allow said cavity to receive said gas.

* * * * *